US005266774A

United States Patent [19]

Kimura et al.

[11] Patent Number: 5,266,774

[45] Date of Patent: Nov. 30, 1993

[54] SET TEMPERATURE CHANGEABLE IMAGE FIXING APPARATUS

[75] Inventors: Shigeo Kimura, Yokohama; Kensaku Kusaka; Atsushi Hosoi, both of Kawasaki; Akira Yamamoto, Tokyo, all of Japan

[73] Assignee: Canon Kabushiki Kaisha, Tokyo, Japan

[21] Appl. No.: 963,529

[22] Filed: Oct. 20, 1992

Related U.S. Application Data

[63] Continuation of Ser. No. 636,241, Dec. 31, 1990, abandoned.

[30] Foreign Application Priority Data

Jan. 9, 1990 [JP] Japan ..... 2-002317

[51] Int. Cl.[5] ..... G03G 15/20

[52] U.S. Cl. ..... 219/216; 355/285

[58] Field of Search ..... 355/289, 290, 285; 219/216, 388

[56] References Cited

U.S. PATENT DOCUMENTS

| | | | |
|---|---|---|---|
| 3,578,797 | 5/1971 | Hodges | 219/388 X |
| 3,810,735 | 5/1974 | Moser | 219/216 X |
| 3,811,828 | 5/1974 | Ohta et al. | 219/216 X |
| 4,161,644 | 7/1979 | Yanagawa et al. | 219/216 |
| 4,566,779 | 1/1986 | Coli et al. . | |
| 4,780,742 | 10/1988 | Takahashi et al. | 219/216 X |
| 4,954,845 | 9/1990 | Yano et al. | 355/290 |
| 4,998,121 | 3/1991 | Koh et al. | 346/160 |

FOREIGN PATENT DOCUMENTS

| | | |
|---|---|---|
| 0222120 | 5/1987 | European Pat. Off. . |
| 0295901 | 12/1988 | European Pat. Off. . |

*Primary Examiner*—R. L. Moses

*Attorney, Agent, or Firm*—Fitzpatrick, Cella, Harper & Scinto

[57] ABSTRACT

An image fixing apparatus includes a heater maintained at a controlled temperature; a film contacted to the heater and movable together with and in sliding contact with a recording material carrying a visualized image, wherein the visualized image is heated by the heater through the film; a temperature detecting element for detecting a temperature of the film or a member contacted to the film; and a controller for changing a level of the controlled temperature on the basis of an output of the temperature detecting element before start of an image fixing operation of the image fixing apparatus.

13 Claims, 6 Drawing Sheets

SET TEMPERATURE CHANGEABLE IMAGE FIXING APPARATUS

This application is a continuation of application Ser. No. 07/636,241 filed Dec. 31, 1990, now abandoned.

FIELD OF THE INVENTION AND RELATED ART

The present invention relates to an image heat-fixing apparatus wherein a recording material bearing a visualized image is urged through a film toward the heater, by which the image is fixed.

As for the image fixing apparatus used in an image forming apparatus such as a copying machine or an electrophotographic printer, a heat-roller type image fixing system is widely used. However, this system involves a problem in that the waiting period is long for the surface of the heating roller to reach a predetermined temperature.

U.S. applications Ser. Nos. 206,767, 409,341, 435,247, 430,437, 440,380, 440,678, 444,802 and 446,449 and U.S. Pat. Nos. 4,954,845, 4,998,121, and 5,026,276 which have been assigned to the assignee of this application have proposed an image fixing apparatus comprising a low thermal capacity heater and a thin film, wherein the waiting period is significantly reduced or eliminated. In this film fixing system, if the temperature of the heater is controlled to be constant, the quantity of the heat applied to the toner image by the nip varies if the temperature of the fixing film varies.

The inventors have made thermal analysis on the relationship between the surface temperature of the fixing film immediately before the nip (the temperature on that surface of the fixing film which is contactable to the toner image of the recording material) in other words, the initial surface temperature and the temperature increase with time after entering the nip.

The results are shown in FIGS. 9A and 9B, wherein FIG. 9A relates to the fixing film having a thickness of 40 microns, and FIG. 9B relates to the fixing film having the thickness of 80 microns. In the graphs, a curve (1) represents the film surface temperature at which the image fixing operation is possible (fixable temperature which is approximately 200° C. in this Example);

a curve (2) represents the surface temperature of the fixing film when the initial surface temperature is 130° C.; and a curve (3) represents the fixing film surface temperature when the initial temperature is 20° C.

As will be understood from the graphs of FIGS. 9A and 9B, when the fixing film surface temperature before entering the nip is low, the time required for the temperature of the fixing film to reach the fixable temperature during the passage of the nip is long, and therefore, the effective toner image heating period is short. If the fixing film has a significant thickness, it can occur that the fixable temperature is not reached until the fixing film has passed through the nip (curve (3) in FIG. 9B).

Since the temperature of the fixing film is low immediately after the main switch is actuated or after the apparatus is left unused, the low temperature toner offset can occur due to insufficient fusing of the toner.

If the temperature of the heater is increased in an apparatus wherein the recording sheet is separated from the film when the temperature of the toner is higher than then glass transition point, the high temperature toner offset can occur due to the overfusing of the toner if the continuous fixing operation is carried out.

SUMMARY OF THE INVENTION

Accordingly, it is a principal object of the present invention to provide an image fixing apparatus wherein substantially the same quantity of heat can be applied to a visualized image irrespective of the initial temperature of the fixing film.

It is another object of the present invention to provide an image fixing apparatus wherein the power supply to the heater can be changed, in accordance with a temperature of the fixing film.

It is a further object of the present invention to provide an image fixing apparatus wherein the setting temperature for the heater is changed in accordance with the temperature of the fixing film.

It is a further object of the present invention to provide an image fixing apparatus wherein the temperature of the fixing film is controlled on the basis of an output of a temperature detecting means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 8:
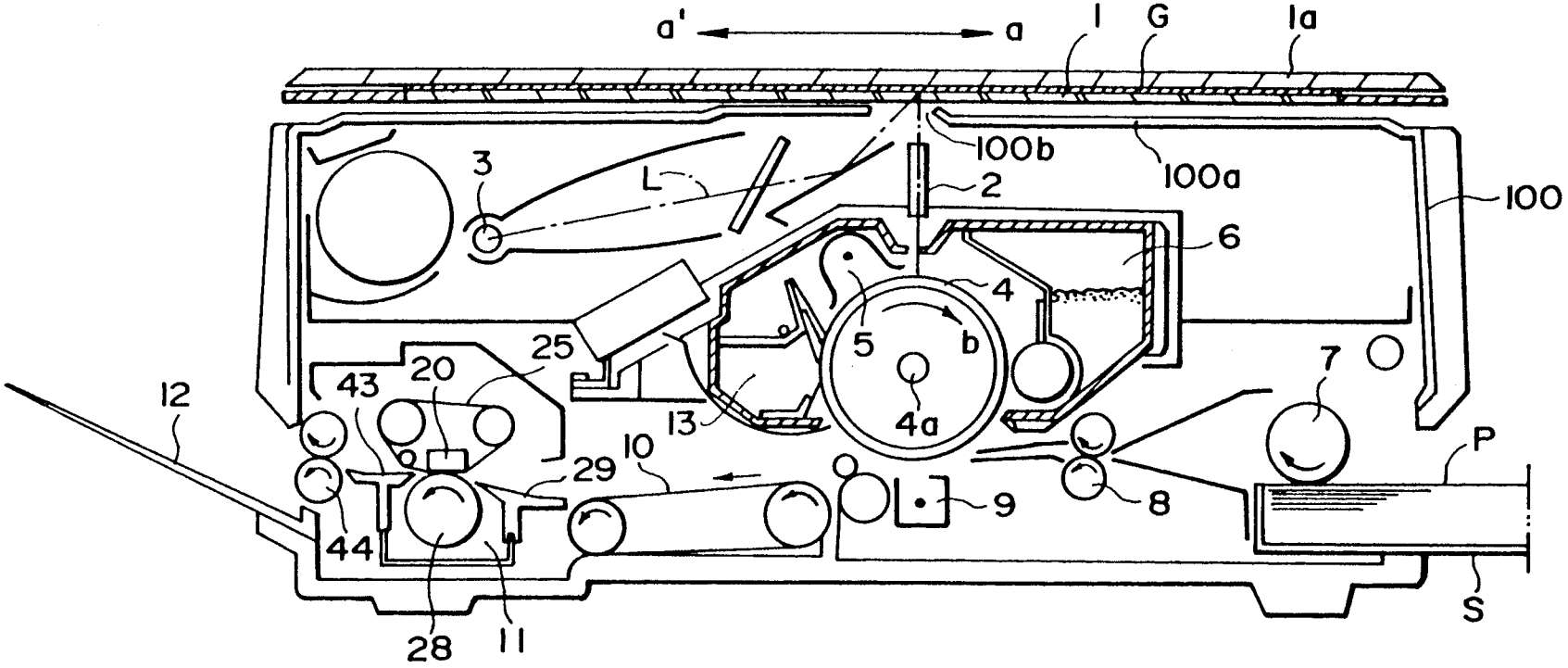
FIG. 8 is a sectional view of an example of an image forming apparatus.
Figure 9A:
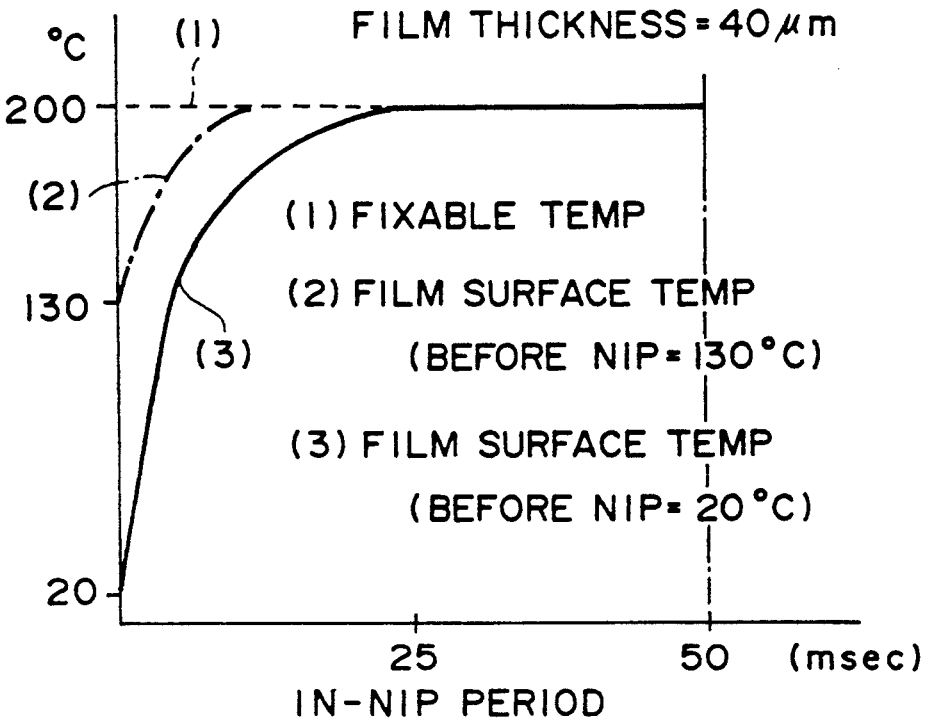
FIGS. 9A and 9B are graphs of a relation between a time period in which the fixing film is in the nip and a fixing film surface temperature, when the thickness of the fixing film is 40 microns and 80 microns.
Figure 9B:
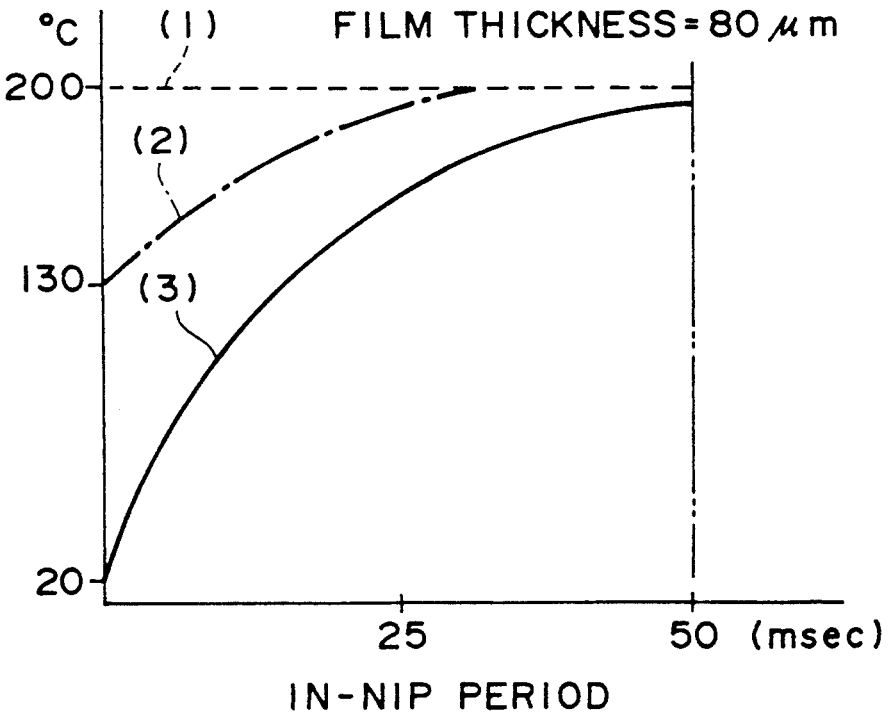

Referring to FIG. 8, there is shown an image forming apparatus using an image fixing apparatus according to an embodiment of the present invention. The image forming apparatus is an image transfer type electrophotographic apparatus which comprises a reciprocable original supporting carriage and a rotatable drum.

The apparatus comprises a casing 100, a reciprocable original supporting carriage 1 made of transparent material such as glass or the like disposed above the top plate 100*a* of the casing 100. The original carriage 1 reciprocates above the plate 100*a* in the left and right directions (a–a').

An original G is placed face down on the original carriage 1 in alignment with the reference position. Then, the original is covered with an original cover 1*a*.

A slit opening 100*b* is formed in the top plate 100*a*, extending in a direction perpendicular to the reciprocal movement direction of the original carriage 1 (perpendicular to the sheet of the drawing). Through the slit 100*b* the original is illuminated.

The surface of the original image of the original G placed on the original carriage 1 is passed by the slit opening 100*b* from the right side to the left side during the forward movement (a) of the original carriage 1. During this, the original image receives the light L through the slit 100*b* through the transparent original carriage 1, so that the original is scanned. The light reflected by the original is imaged on the surface of the photosensitive drum 4 through an array of imaging elements 2 having short focus and small diameter.

The photosensitive drum 4 has a photosensitive layer such as a zinc oxide photosensitive layer or an organic photosensitive layer, and is rotatable in a direction indicated by an arrow b at a predetermined peripheral speed about the central axis 4*a*. During the rotation, the photosensitive member is uniformly charged to a positive or negative polarity. The surface thereof thus charged is exposed to the image light from the original through a slit, so that an electrostatic latent image is formed on the photosensitive drum 4.

The electrostatic latent image is visualized sequentially by a developing device 6 with toner made of heat-softenable or -fusible resin material or the like. Then, the toner image (visualized image) is conveyed to an image transfer station having a transfer discharger 9.

A cassette S accommodates transfer sheet materials (recording material). From the cassette S, a sheet is singled out by rotation of a pick-up roller, and is fed to the photosensitive drum 4 by registration rollers 8 in such a timed relation that when the leading edge of the toner image reaches the transfer charger 9 position, the leading edge of the transfer sheet P reaches the position between the transfer discharger 9 and the photosensitive drum 4. To the surface of the thus fed transfer sheet, the toner image is sequentially transferred from the photosensitive drum 4 by the transfer discharger 9.

The transfer sheet having received the transferred image, is separated from the surface of the photosensitive drum 4 by an unshown separating means, and is conveyed by a conveying device 10 to an image fixing apparatus 11 where it is subjected to an image fixing operation by heat so that the unfixed toner image Ta is fixed. Finally, it is discharged along a guide 43 and discharging rollers 44 to a discharge tray 12 outside the apparatus as a print (copy).

The surface of the photosensitive drum 4 after the image transfer is subjected to a cleaning operation by a cleaning device 13, by which the residual toner or contamination is removed, so that it is prepared for a repeated image forming operation.

An image fixing apparatus according to this embodiment will be described.

Figure 1:
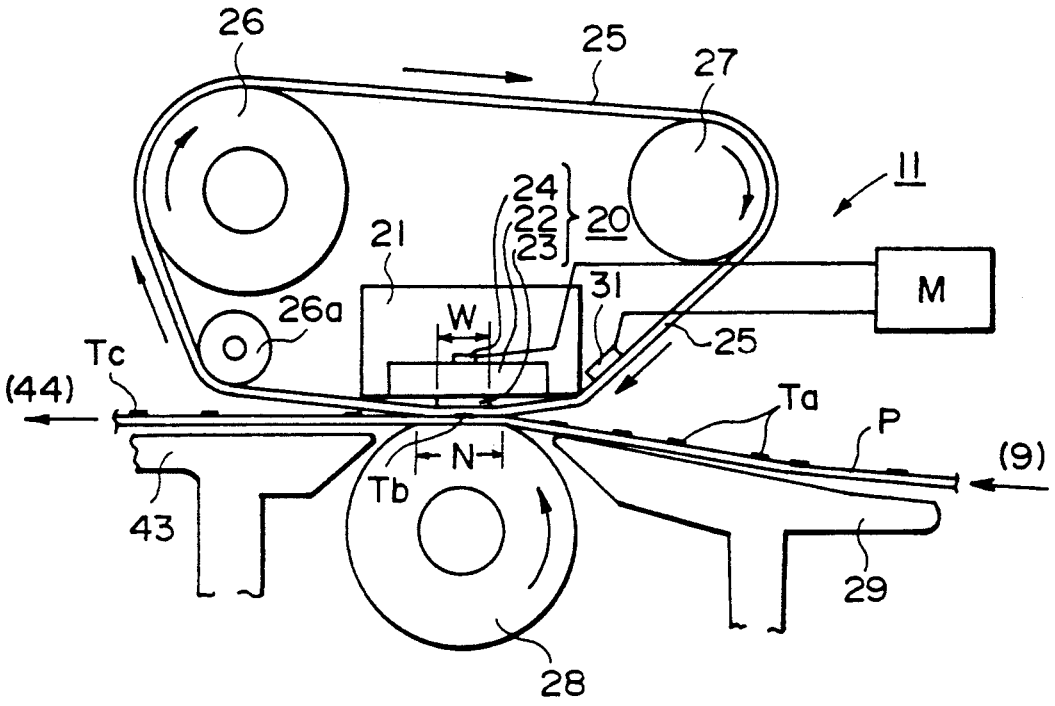
FIG. 1 is a sectional view of an image fixing apparatus according to an embodiment of the present invention.

FIG. 1 is a sectional view of the fixing apparatus 11. A fixing film 25 in the form of an endless belt is stretched around four parallel members, namely, a left driving roller 26, a right follower roller 27, a low thermal capacity linear heater 20 fixed below a position between the rollers 26 and 27 and a guiding roller 26*a* disposed below the driving roller 26.

The follower roller 27 functions also as a tension roller for the film 25. The fixing film 25 is rotated without crease, snaking movement or delay in the clockwise direction by the rotation of the driving roller 26 in the clockwise direction, at a peripheral speed which is the same as the conveying speed of the transfer sheet P (recording material) having the unfixed toner image Ta conveyed from the image forming station 9.

A pressing member 28 in the form of a pressing roller has a rubber elastic layer made of silicone rubber or the like having a good parting property. It presses the bottom travel of the fixing film 25 to the bottom surface of the heater 20 by urging means with a total pressure of 4–7 kg, for example. It rotates codirectionally with the transfer sheet P conveyance, that is, in the counterclockwise direction.

Since the fixing film 25 in the form of an endless belt is repeatedly used for heating and fixing the toner image, it has a sufficient heat-durability, parting property and durability. Generally, the total thickness thereof is not more than 100 microns, and preferably not more than 40 microns.

It may a single layer film of a heat resistive resin such as PI (polyimide), PEI (polyether imide) or PFA (copolymer of tetrafluoroethylene-perfluoroalkylvinylether), or it may be a multi-layer film including a thicker film of 20 microns coated with a parting layer of 10 microns at least on the side contactable to the image, the coating being made of PTFE resin (tetrafluoroethylene resin) added by electrically conductive material.

The heater 20 comprises a heater support 21 extended in a lateral direction (perpendicular to the fixing film 25 moving direction) and having a high rigidity, heat-durability and insulating property. A heater substrate 22 of good heat conductive material is mounted on the bottom side of the support along the length of the support 21.

A heat generating resistor 23 is mounted on the film side of the heater substrate 22, and the heat generating resistor 23 instantaneously generates heat upon electric power supply thereto. At the opposite side of the heater substrate 22, a temperature detecting element 24 is provided to detect the temperature of the heater substrate 22.

The heater support 21 provides the entire mechanical strength of the heater and is made of a heat-durable resin material such as PPS (polyphenylene sulfide), PAI (polyamide imide), PI (polyimide), PEEK (polyether etherketone) or a liquid crystal polymer material or a compound material of such a resin material and a ceramic, metal, glass or the like material.

An example of the heater substrate 22 has a thickness of 1.0 mm, a width of 10 mm and a length of 240 mm, made of alumina.

An example of a heat generating element is in the form of an electric resistor material such as Ag/Pt, $RuO_2$, $Ta_2N$ or the like applied on the bottom surface of the substrate 22 along a substantial center line of the substrate 22 with a width of 1.0 mm, by screen printing or the like. Thus, the heat generating element 23 is a linear or stripe element having a low thermal capacity and activatable by electric power.

A temperature detecting element 24 is in the form of a temperature sensor having a low thermal capacity in the form of a Pt film or thermister. It is applied on the top surface of the substrate 22 along a substantially central longitudinal line of the top surface (opposite from the heat generating element 23 side) In this embodiment, the temperature of the substrate 22 having the good thermal conductivity is detected by the temperature sensor 24 as the temperature of the heater 20.

In this embodiment, the heat generating element 23 is connected to a power source at the opposite longitudinal ends to generate the heat along the entire length of the heat generating element 23. The heat generating element is supplied with electric power on the basis of an output of a fixing film temperature detecting unit 31 which will be described hereinafter and a set (target) temperature so as to compensate the energy emission.

Figure 2:
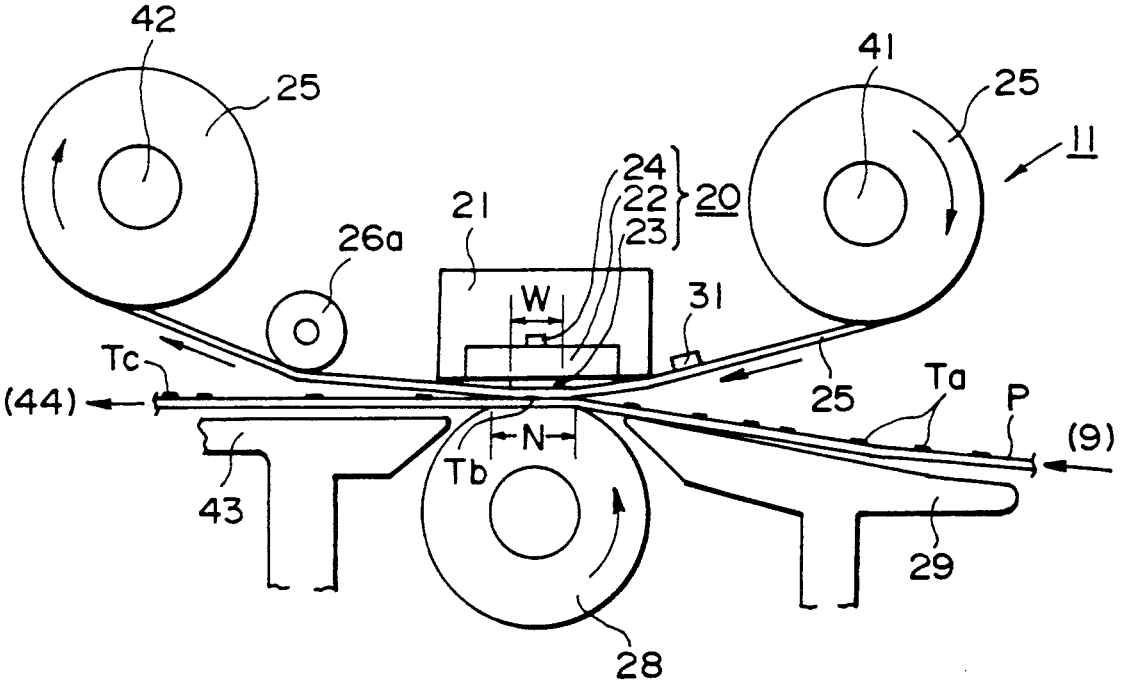
FIG. 2 is a sectional view of an image fixing apparatus according to another embodiment of the present invention.

The fixing film 25 is not limited to the form of the endless belt. It may be as shown in FIG. 2, in the form of a film rolled on a feeding shaft 41 and a take-up shaft 42 and stretched therebetween and between the heater 20 and the pressing roller 28 below a guide roller 26*a*. The fixing film 25 in this case is advanced from the feeding shaft 41 to the take-up shaft 42 at the same speed as the speed of the transfer sheet P.

In order to prevent the wearing and damage of the heat generating element 23, the heater 20 has a protection layer made of $Ta_2O_5$ or the like at the side contactable to the fixing film 25.

In operation, an unshown copy button is depressed, and when an image forming signal is produced, the power supply is effected to reach the set temperature of the heater determined in the manner which will be described hereinafter. After the set temperature is reached, the power supply is controlled to maintain the set temperature.

The transfer sheet P is conveyed to the fixing apparatus 11 from the transfer station 9 by the image forming operation responsive to the image formation start, and is conveyed into the nip N (fixing nip) formed between the fixing film 25 and a pressing roller 28 and by the heater 20 and the pressing roller 28, the heater 20 being temperature-controlled. The sheet P having the unfixed toner image is passed through the fixing film N between the heater 20 and the pressing roller 28 together with the fixing film 20 in close contact with the bottom surface of the fixing film 25 moving at the same speed as the moving speed of the sheet P, without surface deviation and without crease. During this, the sheet P is pressed.

The heat generating element 23 at the bottom of the heater has a width w. The heat generating element 23 is within the width of the fixing nip N, that is, the contact region between the bottom surface of the heater 20 and the top surface of the pressing roller 28 through the fixing film 25.

The toner image bearing surface of the sheet P receives heat through the fixing film 25 from the heat generating element 23, while it is passed through the fixing nip N with pressure-contact therebetween. The toner image is fused by the high temperature and is softened and adhered on the surface of the sheet P (Tb).

In this embodiment, the separation between the sheet P and the fixing film 25 occurs at the point of time when the sheet P has passed through the fixing nip N.

At this point of separation, the temperature of the toner Tb is still higher than the glass transition point of the toner, and therefore, the adherence (bonding force) between the sheet P and the fixing film 25 is small. Therefore, the sheet P is smoothly separated substantially without toner offset to the fixing film 25 surface and substantially without wrapping of the sheet P on the film 25 surface due to improper separation.

Since the toner Tb having the temperature higher than the glass transition point has moderate rubber properties, the toner image surface at the time of separation does not completely follow the surface property of the fixing film so that it has proper roughness. With the surface property maintained, the toner image is cooled and solidified, and therefore, the toner image surface after the image fixing is not too glossy, and therefore, the quality thereof is high.

After the sheet P is separated from the fixing film 25, it is guided along a guide 43 to the discharging roller couple 44. During this, the temperature of the toner Tb increases from the temperature above the glass transition point decreases by spontaneous cooling down to a point lower than the glass transition point, and therefore, it is solidified into a toner image Tc. The sheet P having the fixed image is discharged onto the tray.

The temperature control of the heater will be described.

In FIGS. 1 and 2, there is shown a temperature detecting unit 31 disposed in contact with an inside surface of the fixing film 25 upstream of the fixing nip N with respect to the movement direction of the fixing film.

Figure 3:
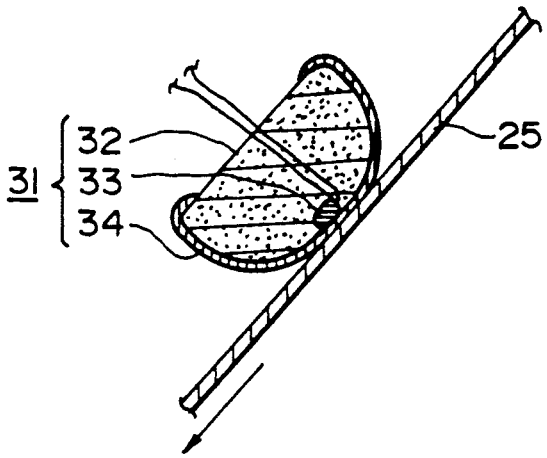
FIG. 3 is an enlarged sectional view of a temperature detecting unit for detecting a fixing film temperature.

The unit 31 as shown in FIG. 3 comprises a silicone sponge 32, a temperature detecting element 33 embedded therein and a PTFE tape 34 thereon having a good sliding property. The unit 31 is in contact with the fixing film to detect the temperature of the inside of the fixing film of that portion thereof which is immediately before the fixing nip N, before the heater is energized with electric power.

The information of the detected temperature is fed back to a microcomputer M of a heater control system as a controlling factor.

Figure 5:
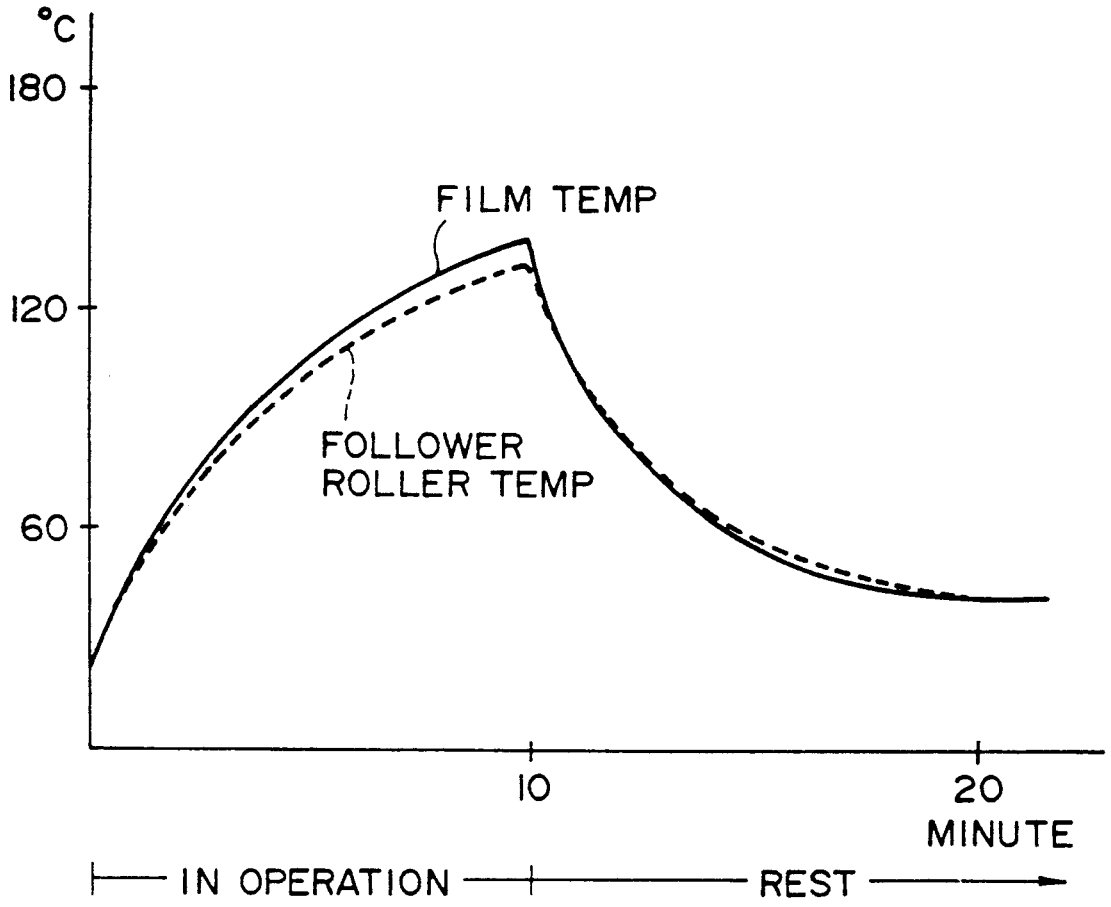
FIG. 5 is a graph of a fixing film temperature and a follower roller temperature during the fixing operation and during non-operation.

The inventors' experiments using a commercially available toner for a Canon FC copying machine have shown that if the fixing film has a temperature of 20° C. immediately before the nip, the sufficient image fixing operation is not possible unless the temperature of the heater 20 is maintained above 190° C. (minimum fixable temperature); and that if the temperature is not lower than 210° C., the toner is fused too much with the result of toner offset. As shown in FIG. 5, the respective temperatures are different depending on the temperature of the fixing film immediately before the nip.

Figure 4:
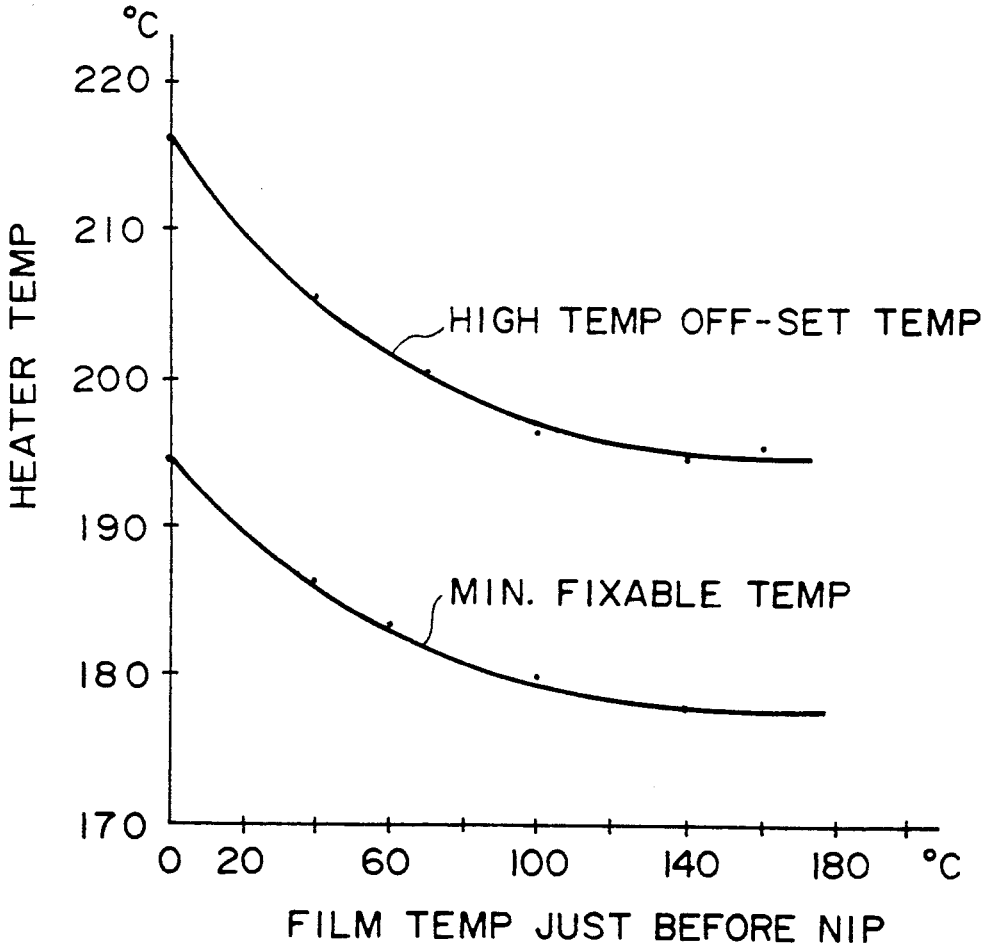
FIG. 4 is a graph of a fixing film temperature immediately before the fixing nip, a heater temperature, a high temperature offset temperature and a minimum fixable temperature.

In this embodiment, the set temperature of the heater control system is changed using a microcomputer, in accordance with the temperature of the fixing film detected by the temperature detecting unit 31 in accordance with the table 1 which is determined on the basis of the results shown in FIG. 4.

More particularly, when the temperature of the fixing film upon the start of the fixing operation is not higher than 30° C., as in the case that the fixing apparatus is left unused for a long period of time, the set temperature is selected to maintain 200° C. during the fixing operation. When the temperature of the fixing film is increased, and it becomes 31°-60° C., the temperature of 195° C. is selected, and further when the temperature becomes 61°-100° C. the temperature is selected to be 190° C. When the temperature of the fixing film is not lower than 101° C., the control temperature is lowered to 185° C.

TABLE 1

| Fixing Film Temp. | Heater Control Temp. |
|---|---|
| 0–30° C. | 200° C. |
| 31–60° C. | 195° C. |
| 61–100° C. | 190° C. |
| 101° C. or higher | 185° C. |

Thus, even if the quantity of heat deprived the fixing film changes, the good fixed images can be produced without improper image fixing attributable to the low temperature of the fixing film and without the high temperature toner offset attributable to the too high temperature of the fixing film during a long continuous fixing operation.

Another embodiment will be described. In the foregoing embodiment, the temperature of the fixing film is directly detected However, when the thickness of the fixing film is very small, not more than 20 microns, for example, the fixing film may be damaged by the sliding with the temperature detecting unit 31. When the temperature is detected without contact, a constant clearance (0.3 mm, for example) is not easily maintained in consideration of the waving motion of the fixing film. Therefore, the temperature is not always detected correctly.

In order to solve the problem, this embodiment is intended to particularly note that the temperature of the follower roller, the temperature of the pressing roller or another member other than the fixing film 25 changes in the similar manner as the fixing film temperature. Then, the temperature of the member other than the fixing film 25 is detected to switch the control temperature for the heater is switched.

Figure 6:
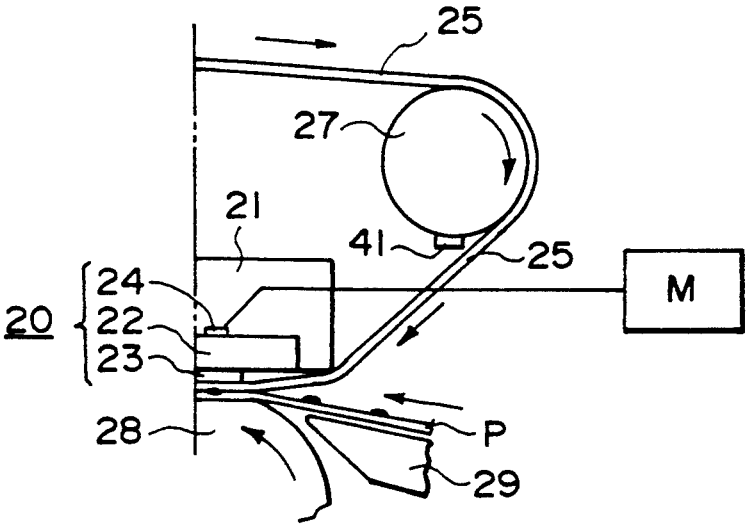
FIG. 6 shows a part of the fixing apparatus, illustrating a temperature detecting element for the follower roller.

FIG. 5 shows the temperature change of the fixing film 25 and the follower roller 27 when the fixing apparatus is stopped after it is operated for 10 min. As will be understood, the temperature changes have a similarity. In the apparatus of this embodiment, as shown in FIG. 6, the temperature detecting element 41 is used to detect the follower roller 27 temperature. When it detects a temperature not higher than 60° C., the heater 20 is controlled to be 193° C.; and when it is higher than 60° C., the heater 20 is controlled to be 188° C.

The system in which the temperature of the fixing film is predicted on the basis of the detected temperature of the part other than the fixing film 25 is advantageous in that the contact of the temperature detecting element to the fixing film 25 is not required and that the durability of the fixing film 25 is increased.

In this embodiment, the temperature of the follower roller 27 is detected, but it is a possible alternative that the temperature in the neighborhood of the fixing film 25, such as the temperature of the driving roller 25 or the pressing roller 28 is detected.

In a fixing apparatus in which the movement of the fixing film 25 is so stabilized that the gap between the temperature detecting element 31 and the fixing film 25 can be maintained constant, a non-contact type temperature sensor is effectively usable.

A further embodiment will be described. When the fixing apparatus is at rest, so that the power supply to the heater is not effected, the temperature of the heater 20 changes similarly to the fixing film.

Therefore, in this embodiment, the temperature detecting element 24 for the heater 20 is used to detect the temperature of the heater prior to the start of the image fixing operation, and on the basis of the detection, the set temperature during the fixing operation is changed.

According to this embodiment, the necessity for the particular temperature detecting element is eliminated.

Figure 7:
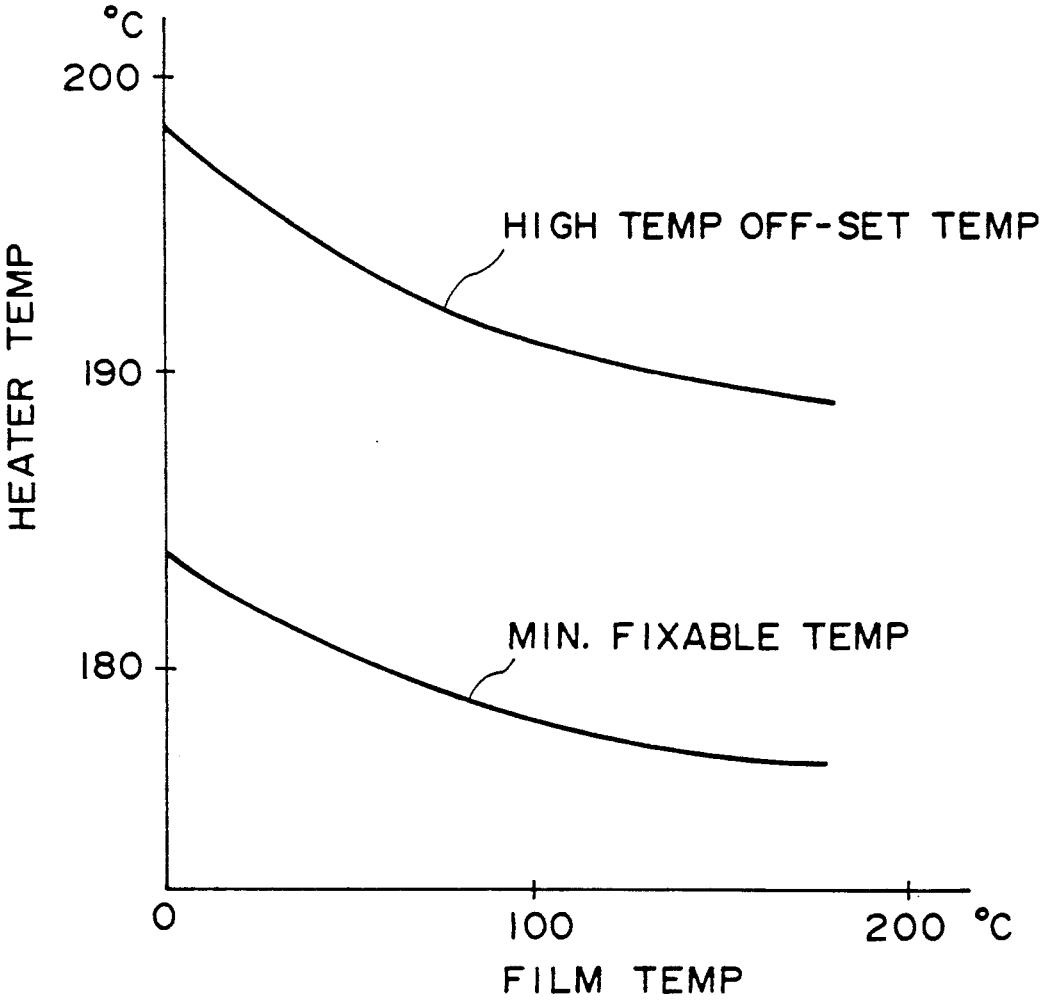
FIG. 7 is a graph of relations among an image fixing film temperature, a heater temperature, a high temperature offset temperature and a minimum fixable temperature.

When a heat fixing toner A (Canon Kabushiki Kaisha) is used, when the temperature of the fixing film is not higher than 60° C., the optimum temperature of the heater is 190° C., as shown in FIG. 7 showing the relation between the fixing film temperature and the heater temperature. However, when the temperature of the fixing film is not lower than 140° C., the temperature 190° C. of the heater is too high, and the temperature 185° C. is proper.

Accordingly, in this embodiment, when the fixing film temperature detected by the temperature detecting element 24 for the heater 20 before the start of the image fixing operation is not higher than 60° C. the power supply is such that the temperature of the heater 20 is 190° C. When the temperature of the fixing film is already not lower than 60° C. before the start of the fixing operation, the heater 20 is controlled to be 185° C. from the first copy. By doing so, the sufficient image fixing power without toner offset can be provided.

In the image fixing apparatus of this embodiment, the temperature of the fixing film increases by approximately 60° C. by the power supply for one minute (which corresponds to 5 sheets processing), until the temperature of the fixing film reaches approximately 140° C. In consideration of this, the continuous energy supply period is counted from the start of the operation by the microcomputer, during the continuous operation, on the basis of which the temperature of the film can be predicted. When the predicted temperature reaches 60° C., the control temperature for the heater 20 is switched to 185° C.

By predicting the temperature rise of the fixing film 25 in this manner, the high temperature offset does not occur even if the control temperature is controlled on the basis of the temperature of the heater 20 before the start of the fixing operation and even if the fixing operation is carried out continuously.

In this embodiment, the temperature of the fixing film 25 is predicted on the basis of the continuous power supply period, but it may be effected on the basis of the number of continuously processed sheets.

As for the control method, the setting temperature of the control system is changed in the foregoing embodiment, but it is a possible alternative to change the power supply to provide the same effects on the basis of the detection of the film temperature or the like.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising a heater for fixing an unfixed image;

control means for controlling power supply to said heater so as to maintain a predetermined fixing temperature;

a film contacted to said heater and movable together with a recording material carrying a visualized image, wherein the visualized image is heated by said heater through said film;

a temperature detecting element for detecting a temperature of at least one of said film and a member contacted to said film; and means for changing said predetermined fixing temperature on the basis of an output of said temperature detecting element.

2. An apparatus according to claim 1, wherein said temperature detecting element detects a temperature of said heater, and during the fixing operation, said control means controls power supply to said heater so that the fixing temperature is maintained substantially at the detected temperature.

3. An apparatus according to claim 1, wherein said predetermined temperature is determined by said control means before start of power supply to said heater.

4. An apparatus according to claim 1, wherein said temperature detecting element detects the temperature of a side of said film contactable to the visualized image.

5. An apparatus according to claim 1, wherein said temperature detecting element detects the temperature of the member contacted to a side of said film opposite from another side of said film contactable to the visualized image.

6. An apparatus according to claim 1, wherein said heater is fixed during fixing operation, and said film is in sliding contact with said heater.

7. An apparatus according to claim 6, wherein said heater comprises a base plate and a heat generating resistor layer on a film side of the base plate generating heat upon electric power supply thereto, and the heat from the heat generating resistor layer is transferred to the visualized image without air layer therebetween.

8. An apparatus according to claim 1, wherein the visualized image comprises powdery toner, and the recording material is separated from said film while a temperature of the toner is higher than a glass transition point of the toner.

9. An apparatus according to claim 1, wherein said film is in the form of an endless belt.

10. An apparatus according to claim 7, wherein a thickness of said film is not more than 100 microns.

11. An apparatus according to claim 10, wherein a thickness of said film is not more than 40 microns.

12. An image fixing apparatus according to claim 1, wherein said control means increases said power supply to said heater on the basis of the detected temperature of said temperature detecting element before start of an image fixing operation of said image fixing apparatus.

13. An apparatus according to claim 1, wherein said control means controls said power supply to said heater on the basis of an output of said temperature detecting element before start of an image fixing operation of said image fixing apparatus.

* * * * *

UNITED STATES PATENT AND TRADEMARK OFFICE

CERTIFICATE OF CORRECTION

PATENT NO. : 5,266,774
DATED : November 30, 1993
INVENTOR(S) : SHIGEO KIMURA, ET AL.

It is certified that error appears in the above-identified patent and that said Letters Patent is hereby corrected as shown below:

COLUMN 1
Line 68, "then" should read --the--, and "the" should read --then--.
COLUMN 2
Line 12, "changed," should read --changed--.
COLUMN 4
Line 26, "may" should read --may be--.

COLUMN 5
Line 3, "side)" should read --side).--.
COLUMN 6
Line 27, "FIG. 3" should read --FIG. 3,--.
COLUMN 7
Line 18, "detected" should read --detected.--.
COLUMN 8
Line 59, "comprising" should read --comprising:--.
COLUMN 9
Line 26, "during" should read --during a--.

Signed and Sealed this

Sixteenth Day of August, 1994

*Attest:*

Bruce Lehman

BRUCE LEHMAN

*Attesting Officer*

*Commissioner of Patents and Trademarks*